United States Patent [19]

Alf et al.

[11] 4,282,526

[45] Aug. 4, 1981

[54] ROD ANTENNA SUPPORT

[75] Inventors: Reinhard Alf; Kurt Klinkwitz, both of Berlin, Fed. Rep. of Germany

[73] Assignee: Robert Bosch GmbH, Stuttgart, Fed. Rep. of Germany

[21] Appl. No.: 114,671

[22] Filed: Jan. 23, 1980

[30] Foreign Application Priority Data

Feb. 20, 1979 [DE] Fed. Rep. of Germany ..... 2906403

[51] Int. Cl.[3] ..... H01Q 1/32

[52] U.S. Cl. ..... 343/715; 343/882

[58] Field of Search ..... 343/715, 805, 882, 883, 343/900

[56] References Cited

U.S. PATENT DOCUMENTS 3,510,877 5/1970 Turriere ..... 343/882

4,109,251 8/1978 MacDougall ..... 343/882

FOREIGN PATENT DOCUMENTS 1606115 6/1953 Fed. Rep. of Germany ..... 343/882

2708594 8/1978 Fed. Rep. of Germany ..... 343/715

*Primary Examiner*—Eli Lieberman

*Attorney, Agent, or Firm*—Spencer & Kaye

[57] ABSTRACT

A rod antenna support has a foot portion adapted to be affixed to a base and a pivotal joint mounted in the foot portion. The pivotal joint has a socket provided with a slot and a cylindrical body received in the socket for rotary motion in a direction transverse to the longitudinal axis of the foot portion. A terminal screw forming an end portion of a rod antenna projects through the slot of the socket and threadedly engages into a diametral bore of the cylindrical body. The cylindrical body has a throughgoing cylindrical passage which extends transversely to the longitudinal axis of the foot portion. The cylindrical body is rotatably received in the throughgoing passage. A flange-like stop is affixed to the terminal screw outside the socket for being clamped against an external face of the socket when the terminal screw is threaded into the bore.

3 Claims, 3 Drawing Figures

ROD ANTENNA SUPPORT

BACKGROUND OF THE INVENTION

This invention relates to a support for a rod antenna which may be of the telescoping type. The support has a foot portion which is mounted on a vehicle body and which carries a pivotal joint having a shell-like socket provided with a radial slot and a cylindrical part disposed in the socket and pivotal in a direction transverse to the longitudinal axis of the foot portion. The cylindrical pivotal part is provided with a diametral threaded bore into which a terminal screw at the lower end of the rod antenna is threaded. By fully threading the terminal screw of the rod antenna into the pivotal cylindrical part, the latter is immobilized with respect to the socket in the desired angular position.

German Utility Model (Gebrauchsmuster) No. 1,606,115 discloses a pivotal rod antenna for vehicles wherein the antenna rod is carried by a socket (mounted on the vehicle) with the intermediary of a tightenable two-part joint. The joint parts have, at sides oriented towards one another, serrations which, upon tightening a screw connecting the two joint parts, assume a meshing relationship. This known antenna has the disadvantage that for a pivotal motion of the antenna and for the subsequent immobilization in the desired angular position of the antenna a separate tool, such as a screwdriver is necessary. It is a further significant disadvantage of this known structure that after the antenna rod is removed from its support, for example, before driving the vehicle into a car washing system, the joint part remaining secured to the vehicle constitutes a significant safety hazard.

Further, German Laid-Open Application (Offenlegungsschrift) No. 2,708,594 discloses a pivotal telescoping rod antenna wherein the foot portion mounted on the vehicle body carries a joint comprising a cup-shaped shell in which an approximately circular disc is rotatably supported. The disc has, perpendicularly to the disc axis, a throughgoing threaded bore into which there is threaded a terminal screw affixed to the antenna rod. In its fully threaded position, the terminal screw projects from the lower end of the bore and engages the inner shell wall whereby the disc, together with the antenna rod is immobilized in the joint shell in a predetermined angular position. A pivotal joint of this known type has the disadvantage that after repeated loosening and subsequent tightening of the antenna rod, the free end of the terminal screw is damaged and further, the inner side of the socket part is deformed by the free end of the terminal screw so that after a while a secure immobilization of the antenna rod is no longer possible.

SUMMARY OF THE INVENTION

It is an object of the invention to provide an improved rod antenna support of the above-outlined type from which the discussed disadvantages are eliminated.

This object and others to become apparent as the specification progresses, are accomplished by the invention, according to which, briefly stated, the socket of the pivotal joint has a throughgoing cylindrical passage extending in a direction transverse to the longitudinal axis of the foot portion and serves for receiving the pivotal part and further, the terminal screw constituting the lower terminus of the antenna rod has a flange-like stop which is outside of the joint socket and which firmly engages the outer surface of the socket shell when the terminal screw is fully threaded into the pivotal part.

It is an advantage of the invention as outlined above that in the fully threaded-in state the terminal screw cannot be damaged at its free end and also, the inside of the socket cannot be deformed by the free end of the terminal screw. Further, the cup-shaped socket is relatively simple to manufacture.

According to a further advantageous feature of the invention, one end face of the cylindrical pivotal part conforms to the external contour of the pivotal joint, while the other end of the pivotal part as well as the throughgoing passage adjacent to the last-named end are reduced in diameter in such a manner that the pivotal part is axially immovably held in the throughgoing passage of the pivotal part. In this manner, an operationally safe pivotal joint is obtained. Even if the antenna is removed from the pivotal joint, only a smooth, spherical profile of slight heights projects from the vehicle body.

DESCRIPTION OF THE PREFERRED EMBODIMENT

Figure 1:
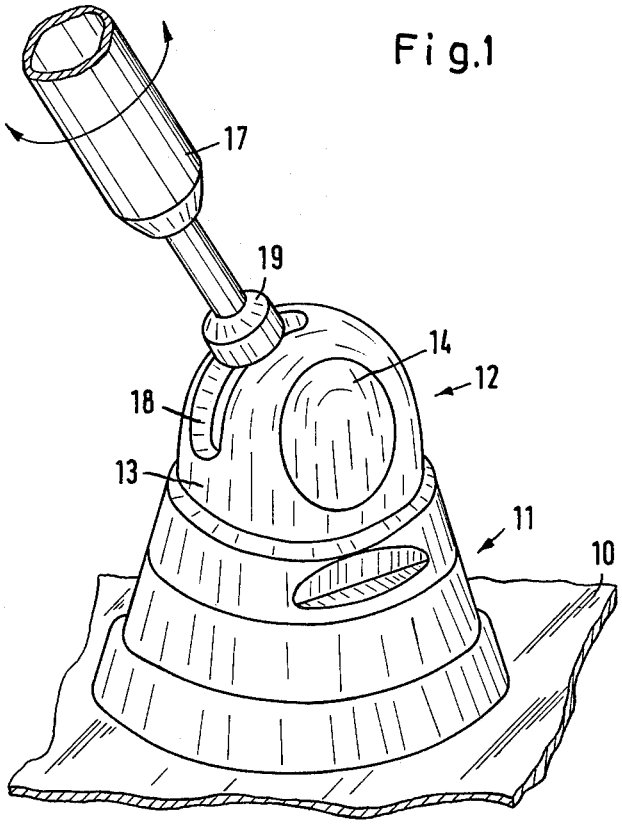
FIG. 1 is a perspective view of a preferred embodiment of the invention.
Figure 2:
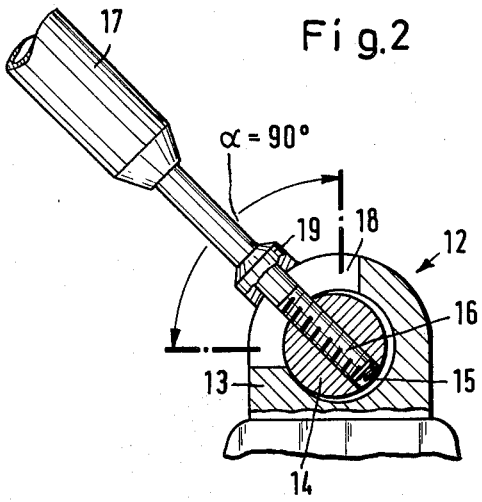
FIG. 2 is a sectional side elevational view of the same embodiment.
Figure 3:
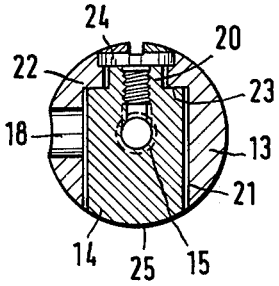
FIG. 3 is a sectional top plan view of the same embodiment in the vertical position of the antenna rod.

Turning now to FIG. 1, to a vehicle body 10 there is mounted a foot portion 11 which carries a pivotal joint 12. The latter is formed of a cup-shaped socket 13 and a cylindrical pivotal part 14 supported in the socket 13.

The pivotal part 14 has a diametrally extending throughgoing threaded bore 15 in which there is threaded a terminal screw 16 of an antenna rod (for example, a telescoping antenna rod) 17. The socket 13 has a radial slot 18 which permits a pivotal motion of the pivotal part 14, together with the antenna rod 17 through an angle of at least 90°.

Above the terminal screw 16 the antenna rod 17 carries a flange-like attachment 19 which, when the antenna rod is fully screwed into the pivotal part 14, is pressed firmly against the outer surface of the socket 13 in the zone adjoining the radial slot 18. At the same time, the pivotal part 14 is pulled firmly against the inner wall of the socket 13, so that the antenna rod 17 is immobilized in the desired angular position.

In order to prevent the pivotal part 14 from falling out of the socket 13 when the antenna rod 17 is removed from the pivotal part 14, one end 20 of the pivotal part 14 has a reduced diameter. The throughgoing cylindrical passage 21 which receives the cylindrical pivotal part 14 has, in the zone of the end 20 of the pivotal part 14, a constriction 22 which is engaged by a shoulder 23 of the pivotal part 14. From the outside of the cylindrical passage 21 there is installed a cylinder-headed screw 24 which cooperates with a shoulder of the socket 13 and which thus permits the pivotal part 14 to be rotated about its longitudinal axis but prevents an axial displacement of the pivotal part 14.

The other end 25 of the pivotal part 14 has a spherical configuration which conforms to the external contour of the socket 13.

The cylinder-headed screw 24 has preferably a convex upper surface which conforms to the external contour of the socket 13.

The flange-like attachment 19 conforms, at its surface oriented towards the socket 13, to the outer contour of the socket 13 in order to ensure a large-surface engagement and to prevent the surface of the socket 13 from being damaged as the antenna rod 17 is tightened into the pivotal part 14.

It will be understood that the above description of the present invention is susceptible to various modifications, changes and adaptations, and the same are intended to be comprehended within the meaning and range of equivalents of the appended claims.

What is claimed is:

1. In a rod antenna support including a foot portion adapted to be affixed to a base and having a longitudinal axis generally perpendicular to the base when the foot portion is mounted thereon; a pivotal joint mounted in the foot portion and having a socket provided with a slot and a cylindrical body received in the socket for rotary motion in a direction transverse to the longitudinal axis of the foot portion; the cylindrical body having a diametral threaded bore; and a terminal screw forming an end portion of a rod antenna; the terminal screw projecting through the slot of the socket and threadedly engaging the threaded bore of the cylindrical body; and clamping means for immobilizing the cylindrical body in a desired angular position when the terminal screw is threaded into the bore; the improvement wherein said socket comprises means defining a throughgoing cylindrical passage having an axis which is transverse to said longitudinal axis of said foot portion; said cylindrical body being rotatably received in said throughgoing passage; and further wherein said clamping means comprises a flange-like stop affixed to said terminal screw outside said socket; said stop engaging an external face of said socket when said terminal screw is threaded into said bore.

2. A rod antenna support as defined in claim 1, further comprising means for preventing axial displacements of said cylindrical body with respect to said throughgoing passage and further wherein said socket has an external contour and said cylindrical body has an externally exposed end having an outer face conforming to said external contour.

3. A rod antenna support as defined in claim 2, wherein said means for preventing axial displacements comprises complemental diametral reductions in an end portion of said cylindrical body and a corresponding end portion of said throughgoing passage; means defining an axial threaded bore extending in said cylindrical body in said end portion thereof; and a screw threaded into said axial threaded bore; said screw having a cylindrical head situated in said throughgoing passage and engaging a shoulder of said socket.

* * * * *